US011148458B2

(12) United States Patent
Riedl et al.

(10) Patent No.: US 11,148,458 B2
(45) Date of Patent: Oct. 19, 2021

(54) METHOD FOR CHANGING AN EDGE OF A PORTABLE CARD-SHAPED DATA CARRIER

(71) Applicant: GIESECKE+DEVRIENT MOBILE SECURITY GMBH, Munich (DE)

(72) Inventors: Josef Riedl, Attenkirchen (DE); Günter Endres, Munich (DE); Klaus Kohl, Miesbach (DE); Thorsten Sauer, Erding (DE)

(73) Assignee: GIESECKE+DEVRIENT MOBILE SECURITY GMBH, Munich (DE)

( * ) Notice: Subject to any disclaimer, the term of this patent is extended or adjusted under 35 U.S.C. 154(b) by 0 days.

(21) Appl. No.: 15/740,839

(22) PCT Filed: Jun. 29, 2016

(86) PCT No.: PCT/EP2016/001103

§ 371 (c)(1),
(2) Date: Dec. 29, 2017

(87) PCT Pub. No.: WO2017/001055

PCT Pub. Date: Jan. 5, 2017

(65) Prior Publication Data

US 2018/0186169 A1 Jul. 5, 2018

(30) Foreign Application Priority Data

Jun. 29, 2015 (DE) ..... 102015008432.1

(51) Int. Cl.
*B42D 25/324* (2014.01)
*B42D 25/43* (2014.01)
(Continued)

(52) U.S. Cl.
CPC ..... *B42D 25/43* (2014.10); *B42D 25/00* (2014.10); *B42D 25/324* (2014.10);
(Continued)

(58) Field of Classification Search
CPC .... B42D 25/324; B42D 25/43; B42D 25/435; B42D 25/445; B42D 25/475
See application file for complete search history.

(56) References Cited

U.S. PATENT DOCUMENTS 7,055,239 B2 6/2006 Ochsner
8,725,589 B1 * 5/2014 Skelding ..... G06Q 20/341 283/72
(Continued)

FOREIGN PATENT DOCUMENTS

DE 102008030182 A1 12/2009
DE 102008033461 A1 1/2010
(Continued)

OTHER PUBLICATIONS

German Search Report from DE Application No. DE 10 2015 008 432.1, dated Apr. 8, 2016.
(Continued)

*Primary Examiner* — Kyle R Grabowski
(74) *Attorney, Agent, or Firm* — Workman Nydegger

(57) ABSTRACT

A method for changing a geometry of an edge of a portable data carrier, wherein the geometry of the edge is changed in order to work on the edge and the outer side of the data carrier proceeding from a common side, without a spatial location of the data carrier being changed.

19 Claims, 5 Drawing Sheets

(51) Int. Cl.

| | |
|---|---|
| ***B42D 25/435*** | (2014.01) |
| ***B42D 25/445*** | (2014.01) |
| ***B42D 25/475*** | (2014.01) |
| ***B42F 21/12*** | (2006.01) |
| ***B42D 25/00*** | (2014.01) |

(52) U.S. Cl.
CPC ..... *B42D 25/435* (2014.10); *B42D 25/445* (2014.10); *B42D 25/475* (2014.10); *B42F 21/12* (2013.01)

(56) References Cited

U.S. PATENT DOCUMENTS

| | | | | |
|---|---|---|---|---|
| 2004/0178624 | A1* | 9/2004 | Kawasaki | G06K 19/041 283/74 |
| 2004/0217178 | A1* | 11/2004 | Lasch | B42D 25/425 235/488 |
| 2005/0062280 | A1 | 3/2005 | Ochsner | |
| 2005/0087606 | A1 | 4/2005 | McCumber | |
| 2010/0164220 | A1* | 7/2010 | Kaskiala | B42D 25/405 283/108 |
| 2012/0043747 | A1* | 2/2012 | Reindl | B42D 1/003 281/21.1 |
| 2014/0224880 | A1 | 8/2014 | Launay et al. | |

FOREIGN PATENT DOCUMENTS

| | | | |
|---|---|---|---|
| EP | 1970211 | A1 | 9/2008 |
| FR | 2709362 | B1 | 9/1995 |
| JP | H04132067 | A | 5/1992 |
| WO | 03041970 | A1 | 5/2003 |
| WO | 2004063977 | A2 | 7/2004 |

OTHER PUBLICATIONS

International Preliminary Report on Patentability from PCT Application No. PCT/EP2016/001103, dated Jan. 11, 2018.
International Search Report from PCT Application No. PCT/EP2016/001103, dated Sep. 16, 2016.

* cited by examiner

METHOD FOR CHANGING AN EDGE OF A PORTABLE CARD-SHAPED DATA CARRIER

BACKGROUND

The invention describes methods for changing an edge of a portable data carrier.

From the prior art methods are known for manufacturing portable data carriers, such as chip cards, credit cards, bank cards, identity cards, insurance cards, driving licenses, etc., which have a colored and/or a personalized edge, which is located between two outer sides of the portable data carrier.

In the prior art, colored foils which are arranged in the interior of the data carrier are employed for manufacturing a portable data carrier with a colored edge. The colored foils are printed planarly from both sides with a white color, which means an elaborate printing process and a high consumption of color. Further, bonding problems with adjacent foils arise in the region of the planar printing, which can be solved only by corresponding, additional lacquering and/or an employment of adhesive-coated foils.

U.S. 2014 224 880 A1 discloses a printing of the edge. For this purpose, several portable data carriers are stacked and subsequently the exterior edges are printed. The disadvantage here is that this is an elaborate process which is not standardized. Furthermore, there is the danger that through the printing process of the stacked data carriers not only the edges are printed but that color runs between the data carriers lying against each other in the stack, and therefore dyes the outer sides of the data carriers as well.

For manufacturing portable data carriers having a personalized edge, the prior art further knows the approach that portable data carriers are employed which have an evenly punched edge, wherein the edge itself has an even surface. With the outer sides of the portable data carrier, the edge encloses respectively an angle of approx. 90 degrees. DE 10 2008 033 461 A1 and EP 1 970 211 A1 disclose corresponding methods. The disadvantage according to prior art is that the processes for printing and/or for personalizing the edge are very elaborate and not standardized, for which there are no standardized fabrication apparatuses.

SUMMARY

It is therefore object of the invention to make available a solution for the above-mentioned problems.

For solving the problem, the invention discloses a method for changing a geometry of an edge of a portable data carrier, which is characterized in that the geometry of the edge is changed in order to work on the edge and at least one outer side of the data carrier proceeding from a common side, without a spatial location of the data carrier being changed. This has the advantage that standardized methods and apparatuses can be employed for the printing and the personalizing on at least one outer side as well as on the edge of the portable data carrier. The portable data carrier can be worked on according to the invention in a spatial location such that an outer side of the data carrier as well as the edge running around the outer side can be worked on, e.g. printed and/or personalized and/or marked, without the data carrier having to be changed in its spatial location, e.g. having to be swiveled or rotated, in order to work on the edge. This has the great advantage that the manufacturing of portable data carriers is possible faster and more cost-efficiently with the method according to the invention than with the methods of the prior art.

An advantageous embodiment example of the invention is that the edge is worked on by printing the edge by means of a printing method. Any suitable printing method comes into consideration for the printing method, such as e. g. a pad printing method. Therefore, for example, the edge can be printed to create a colored frame around at least one outer side of the data carrier, wherein the printed edge is also known by the term Colored Edge.

A further advantageous embodiment example of the invention is that the edge is worked on by marking the edge by means of a laser method. The laser method is a standardized method, e.g. for personalization, by means of which according to the invention the edge can easily be worked on, e.g. marked or personalized, without e.g. the edge having to be moved in its spatial location, in order that a laser can e.g. mark the edge. Further, the laser method is suited in particular for the later working on the edge, thus after completion of the manufacturing method of the portable data carrier.

A further advantageous embodiment example of the invention is that the geometry of the edge is changed such that it is diagonal and/or circular with regard to at least one outer side of the data carrier. The oblique or circular geometry of the edge are merely two exemplary possibilities for the possible geometry of the edge to be able to work on at least one outer side and the edge of one side of the portable data carrier according to the invention, without the spatial location of the portable data carrier having to be changed and without special apparatuses and methods having to be employed, but rather that conventional apparatuses and methods can continue to be utilized. Alternatively, e.g. a geometry is expedient in which in the course of the edge around the outer sides of the portable data carrier e.g. a circular geometry changes into an oblique one. Furthermore, the geometry has to extend not over a total height of the portable data carrier but can extend only over a part of the height. The edge itself can be manufactured e.g. by means of a punching method. Alternatively, the edge can also be configured by means of a laser method or a mechanical milling method. Further, the edge can be manufactured during or after the manufacturing method of the portable data carrier.

A further advantageous embodiment example of the invention is that a data carrier is employed, which in its interior has at least one white foil and on both outer sides respectively an overlay foil as an outermost foil. The employment of this construction has particularly advantageous properties insofar as a marking of the edge, e.g. by a printing and/or marking a high contrast is created, wherein a viewer recognizes the marking on the edge particularly well and distinctly.

Hereinafter, advantageous embodiment examples of the invention are described.

DETAILED DESCRIPTION OF VARIOUS EMBODIMENTS

Figure 1:
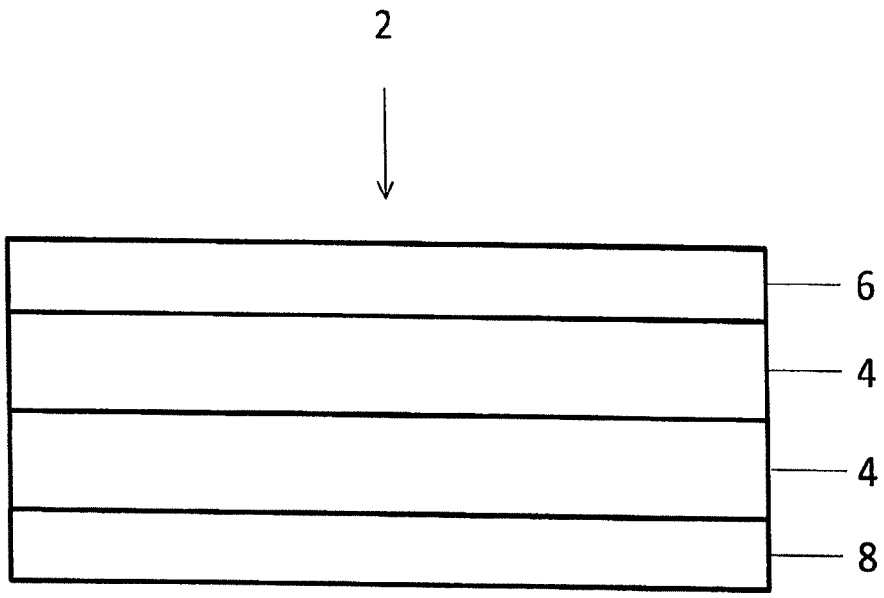
Prior Art Fig. 1
FIG. 1 shows a schematic construction of a card-shaped data carrier according to prior art in cross section.

FIG. 1 shows a card-shaped data carrier 2 according to prior art. The data carrier 2 comprises in the interior of the data carrier 2 e.g. two white foils 4. The white foil 4 is a dyed foil as it is commercially available. On the two outer sides of the composite, consisting of the two white foils 4, respectively an overlay foil 6 and 8 is arranged as an outermost foil layer. To e.g. print or mark the circumferential edge, it is necessary that the portable data carrier is moved such that the edge can be worked on, e.g. by means of a printing method or laser method. This is very elaborate and represents a disadvantage of the prior art, which is overcome by the present invention.

The FIGS. 2, 3, 4 and 5 disclose respectively an embodiment example of a card-shaped data carrier 12 according to the invention having different geometrical form of an edge 24. The data carrier 12 according to the invention has two white foils 14 in its interior. A first overlay foil 16 is arranged on an upper side of the upper white foil 14. A second overlay foil 18 is arranged on an underside of the lower white foil 14. The geometrical form of the edge 24 is represented as a dashed line. The geometrical form of the edge 24 can be configured during and/or after the manufacturing of the portable data carrier 12. For this purpose, for example, mechanical methods, e.g. a milling method, are suited, or a laser method or any other suitable method to generate the geometrical form of the edge 24. The edge 24 can be printed, e.g. to create a colored border of the portable data carrier. As a further alternative, the edge 24 can e.g. be marked or personalized by means of a laser, to write e.g. user-specific data on the edge 24 of the portable data carrier 12. The effect essential to the invention is that through the geometrical form of the edge 24, at least one outer side 26, 28 as well as the edge 24 itself can e.g. be printed and/or be marked by means of a laser, without the spatial location of the portable data carrier having to be changed. A further advantage of the invention is that the edge 24 can also be manufactured and worked on after the manufacturing of the portable data carrier 12, e.g. printed and/or marked or personalized by means of a laser.

Figure 2:
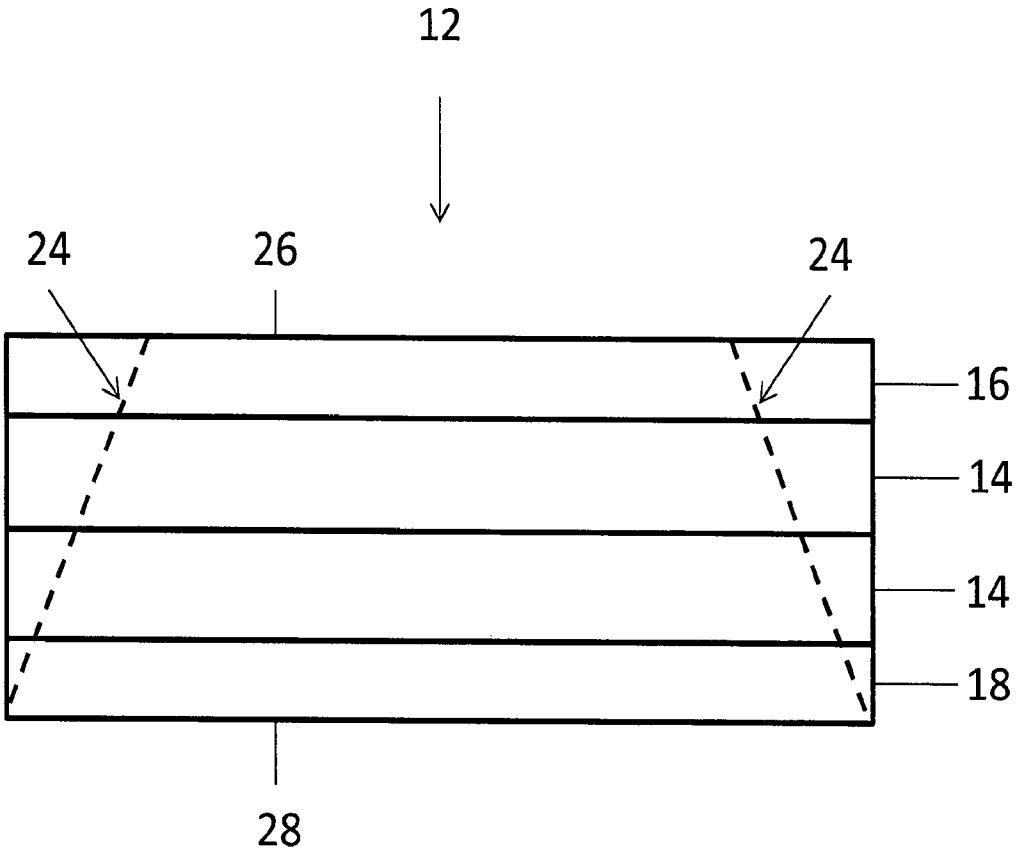
FIGS. 2, 3, 4 and 5 show respectively a construction of a data carrier according to the invention having different geometrical edge forms in cross section.
Figure 3:
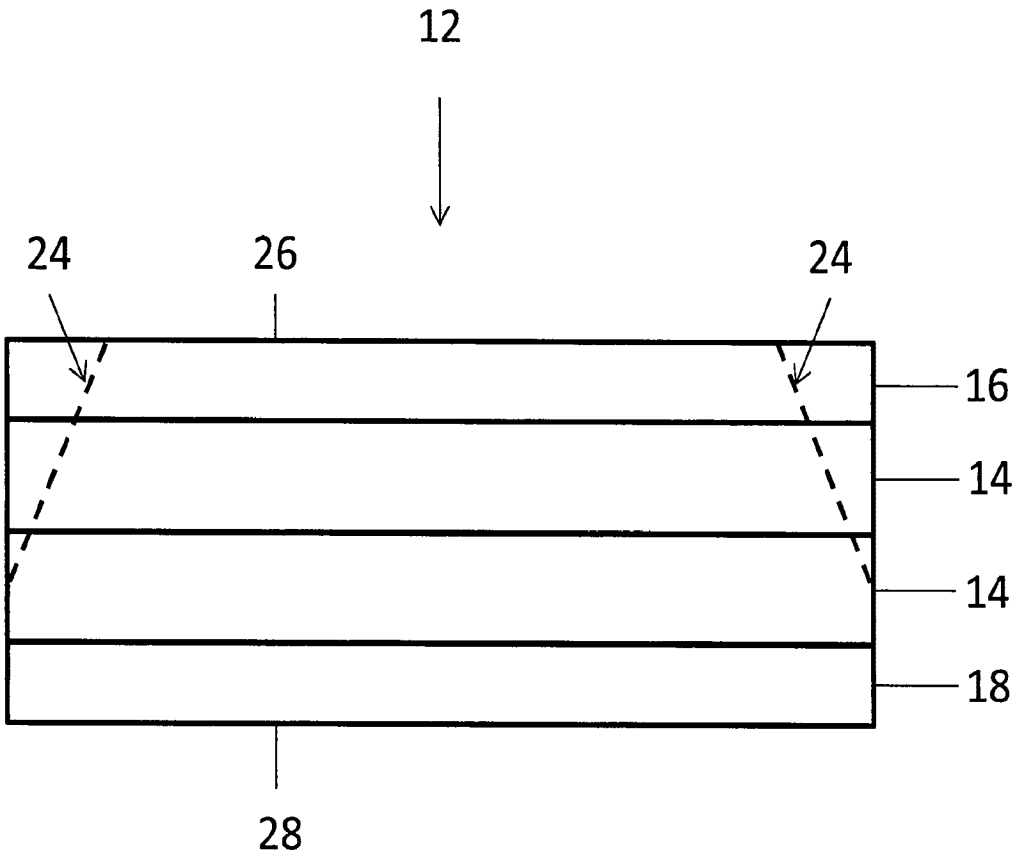
Figure 4:
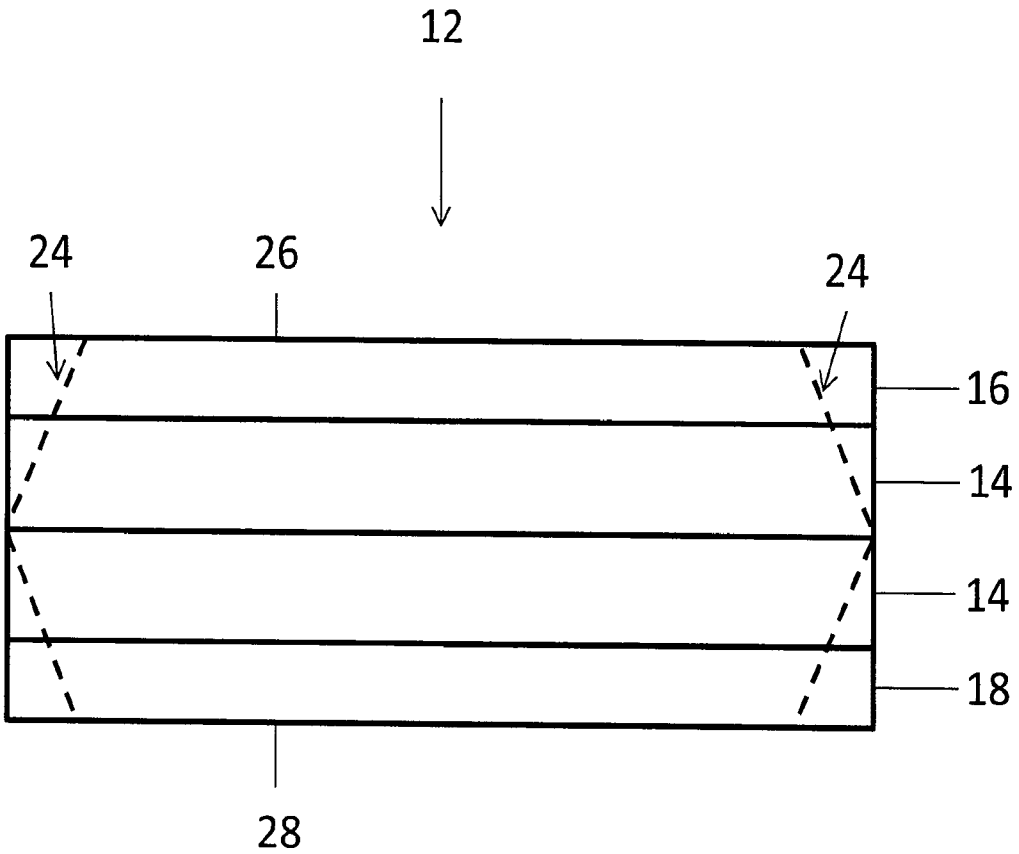
Figure 5:
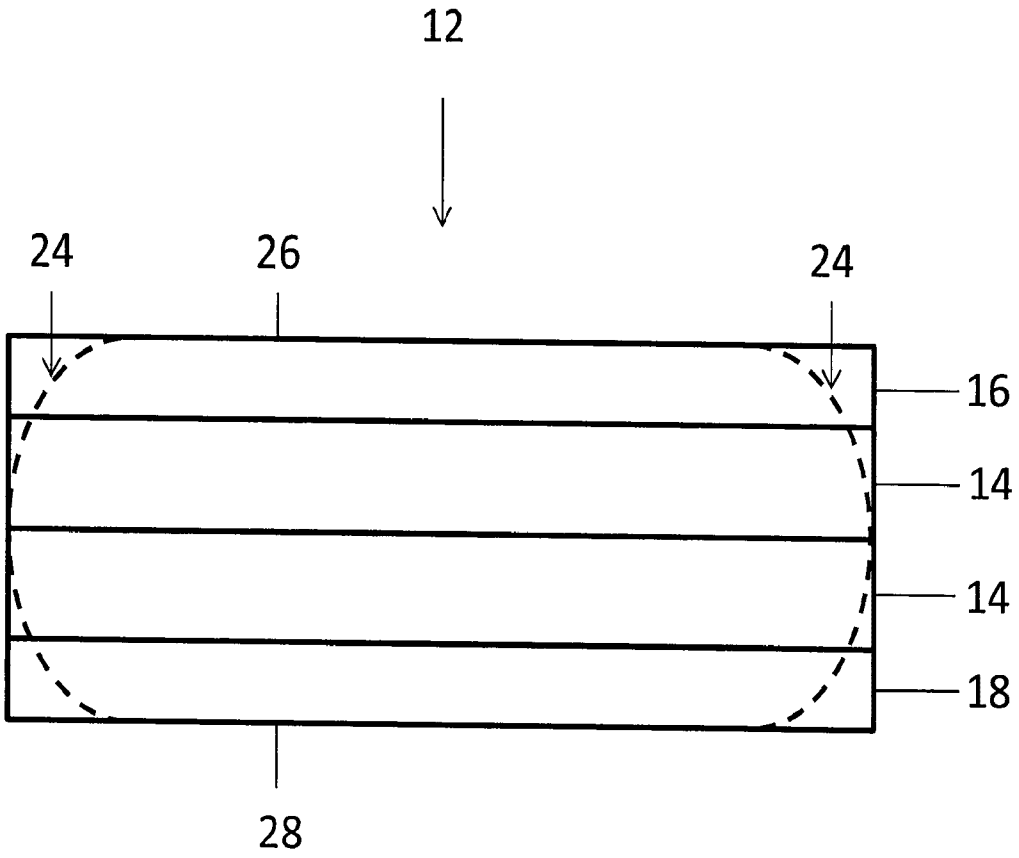

A further advantage of the invention is that the geometrical form of the edge 24 of the data carrier 12 leaves an optical impression upon viewing the data carrier 12 so that when a viewer views an outer side 26, 28 of the data carrier 12, the viewer then simultaneously sees the edge 24 and thus obtains moreover an optical impression of an e.g. colored and/or personalized edge 24 of the data carrier 12. There are different possibilities for the geometrical form of the edge 24. By way of example there are stated in the FIGS. 2 and 3 a form beveled on one side, in FIG. 4 a form beveled on both sides, and in FIG. 5 a rounded form. FIG. 2 shows how the edge 24 extends over the total height of the portable data carrier 12 and all foils of the data carrier 12, and FIG. 3 shows how the edge 24 extends only over a part of the foils or the height of the data carrier 12. All other suitable geometrical forms are likewise possible for the edge 24. Further, it is possible that the edge 24 keeps or changes the geometrical form in its course along the first and second outer side 26 and 28 so that e.g. a circular form passes into a beveled one.

LIST OF REFERENCE SIGNS

2 card-shaped data carrier according to the prior art
4 white foil
6 overlay foil
8 overlay foil
12 card-shaped data carrier according to the invention
14 white foil
16 overlay foil
18 overlay foil
24 geometrical form of the edge
26 first outer side
28 second outer side

The invention claimed is:

1. A method for changing a geometry of an edge of a portable data carrier, the method comprising:

changing the geometry of the edge of the portable data carrier by removing material of the edge, the changed edge comprising at least four edge segments defining a perimeter of an outer side of the data carrier; and marking the changed edge and the outer side of the data carrier without a spatial location of the data carrier being changed;

wherein the geometry of the edge is changed in order to mark the edge and the outer side of the data carrier proceeding from a common side, without the spatial location of the data carrier being changed;

wherein the portable data carrier comprises at least two foil layers, the changed geometry of the edge extending through each of the at least two foil layers;

wherein the changed edge and the outer side of the data carrier are marked in the same marking operation; and wherein a geometric form of at least one of the at least four edge segments varies relative to a geometric form of another of the at least four edge segments.

2. The method according to claim 1, wherein the edge is marked by printing the edge by means of a printing method.

3. The method according to claim 1, wherein the edge is marked by marking the edge by means of a laser method.

4. The method according to claim 1, wherein the geometry of the edge is changed such that it is diagonal and/or circular with regard to the outer side of the data carrier.

5. The method according to claim 1, wherein a data carrier is employed which has in its interior at least one white foil and an overlay foil as an outermost foil.

6. The method according to claim 1, wherein the changed geometry of the edge extends through a total height of the data carrier.

7. The method according to claim 1, wherein the changed geometry of the edge extends through only a part of a total height of the data carrier.

8. The method according to claim 1, wherein the changed geometry of the edge includes a bevel formed on the outer side of the data carrier and an opposing side.

9. The method according to claim 1, wherein the changed geometry of the edge includes a rounded form.

10. The method according to claim 1, wherein the geometric form passes from a circular form to a beveled form.

11. The method according to claim 1, wherein the changed geometry of the edge includes a rounded form and a beveled form.

12. The method according to claim 1, wherein the geometric form of the at least one of the four edge segments varies relative to a geometric form of another of the four edge segments prior to the marking of the changed edge.

13. The method according to claim 1, wherein the geometric form of at least two of the four edge segments varies relative to a geometric form of another of the four edge segments.

14. The method according to claim 1, wherein the geometric form of each of the four edge segments varies relative to a geometric form of each of the other edge segments.

15. The method according to claim 1, wherein the changed edge comprises at least six edge segments defining the perimeter of the outer side of the data carrier.

16. A method for changing a geometry of an edge of a portable data carrier, the method comprising:

changing the geometry of the edge of the portable data carrier by removing material of the edge, the changed edge comprising four edge segments defining a perimeter of an outer side of the data carrier; and marking both the changed edge and the outer side of the data carrier from a common side without a spatial location of the data carrier being changed;

wherein the portable data carrier comprises at least two foil layers, the changed geometry of the edge extending through each of the at least two foil layers;

wherein the changed edge and the outer side of the data carrier are marked in the same printing operation; and wherein a geometric form of at least one of the four edge segments varies along the outer side of the data carrier.

17. The method according to claim 16, wherein the geometric form of at least two of the four edge segments varies along the outer side of the data carrier.

18. The method according to claim 16, wherein the geometric form of each of the four edge segments varies along the outer side of the data carrier.

19. A method for changing a geometry of an edge of a portable data carrier, the method comprising:

changing the geometry of the edge of the portable data carrier by removing material of the edge; and marking the changed edge and an outer side of the data carrier without a spatial location of the data carrier being changed;

wherein the geometry of the edge is changed in order to mark the edge and the outer side of the data carrier proceeding from a common side, without the spatial location of the data carrier being changed;

wherein the portable data carrier comprises at least two foil layers, the changed geometry of the edge extending through each of the at least two foil layers;

wherein the changed edge and the outer side of the data carrier are marked in the same marking operation; and wherein the changed edge has a geometric form which varies along the outer side of the data carrier and passes from a circular form to a beveled form.

* * * * *